US008716658B2

(12) United States Patent
Stones

(10) Patent No.: US 8,716,658 B2
(45) Date of Patent: May 6, 2014

(54) MASS SPECTROMETER SYSTEM

(75) Inventor: Ian David Stones, Burgess Hill (GB)

(73) Assignee: Edwards Limited (GB)

( * ) Notice: Subject to any disclaimer, the term of this patent is extended or adjusted under 35 U.S.C. 154(b) by 207 days.

(21) Appl. No.: 13/394,976

(22) PCT Filed: Sep. 13, 2010

(86) PCT No.: PCT/GB2010/051528
§ 371 (c)(1),
(2), (4) Date: Mar. 8, 2012

(87) PCT Pub. No.: WO2011/036472
PCT Pub. Date: Mar. 31, 2011

(65) Prior Publication Data

US 2012/0168621 A1 Jul. 5, 2012

(30) Foreign Application Priority Data

Sep. 24, 2009 (GB) ..... 0916797.4

(51) Int. Cl.
*F04D 19/04* (2006.01)

(52) U.S. Cl.
USPC ..... 250/289; 415/55.6; 415/90; 417/423.4

(58) Field of Classification Search
USPC ..... 250/289, 281, 282; 415/55.6, 90, 143; 417/423.4
See application file for complete search history.

(56) References Cited

U.S. PATENT DOCUMENTS

| | | | | |
|---|---|---|---|---|
| 6,457,954 | B1 * | 10/2002 | Adamietz et al. | 417/423.4 |
| 8,106,354 | B2 * | 1/2012 | Henry et al. | 250/289 |
| 2007/0148020 | A1 | 6/2007 | McCauley | |
| 2007/0258836 | A1 * | 11/2007 | Hofmann et al. | 417/423.4 |
| 2008/0063541 | A1 * | 3/2008 | Stones | 417/250 |
| 2008/0166219 | A1 * | 7/2008 | Stuart et al. | 415/90 |
| 2011/0286864 | A1 * | 11/2011 | Stones | 417/244 |
| 2012/0201696 | A1 * | 8/2012 | Tollner | 417/199.1 |
| 2013/0177453 | A1 * | 7/2013 | Stones | 417/250 |

FOREIGN PATENT DOCUMENTS

| | | | |
|---|---|---|---|
| DE | 102007010068 | A1 | 9/2008 |
| DE | 102007027352 | A1 | 12/2008 |
| GB | 2455977 | A | 7/2009 |
| JP | 2008095504 | A | 4/2008 |
| WO | 2008151968 | A2 | 12/2008 |
| WO | 2008151968 | A3 | 12/2008 |

* cited by examiner

*Primary Examiner* — Nikita Wells
*Assistant Examiner* — Johnnie L Smith
(74) *Attorney, Agent, or Firm* — Shumaker & Sieffert, P.A.

(57) ABSTRACT

The invention provides a mass spectrometer system (10) comprising a mass spectrometer (12) comprising a plurality of mass spectrometer stages (16, 18, 20, 44) in fluid communication from a low vacuum stage (16) to a higher vacuum stage (44). A split flow multi-stage pump (14) evacuates the mass spectrometer stages. The pump comprises a pump envelope (28) in which a plurality of pumping stages (20, 32, 34) are supported for rotation about an axis X generally parallel to the direction of flow in the mass spectrometer stages for pumping fluid from a main pump inlet (36) to a main pump outlet (38). At least part of a higher vacuum stage (44) is located within the pump envelope at the main pump inlet.

20 Claims, 3 Drawing Sheets

MASS SPECTROMETER SYSTEM

The present invention relates to a mass spectrometer system.

A prior art mass spectrometer system is known for evacuating the stages of a mass spectrometer using a so-called split flow multi-stage pump. Such a pump may comprise a pump envelope in which a plurality of pumping stages are supported for rotation about an axis for pumping fluid from a main pump inlet to a main pump outlet. The main pump inlet is connected for evacuating a high vacuum stage. An inter-stage inlet is provided between pumping stages and is connected for evacuating a lower vacuum stage of the mass spectrometer.

Typically, a split flow pump is orientated 'vertically' with its axis orthogonal to the flow direction from one stage to the next stage of a mass spectrometer. In this regard, the stages of a mass spectrometer comprise a respective plurality of vacuum chambers connected in series to allow flow from a low vacuum chamber to a high vacuum chamber. Each chamber comprises an instrument for processing a sample introduced to the mass spectrometer.

This arrangement, in which more than one mass spectrometer stage at different pressures are evacuated by the same pump, offers advantages in terms of production cost, system size, maintenance and cost of ownership. However, the inter-stage inlet suffers from relatively low conductance and also the pump occupies a relatively large amount of space.

More recently, a mass spectrometer system shown in FIG. 3 has been provided. The mass spectrometer system 100 may, for example, comprise stages 101, 102, 103 of a mass spectrometer 104 evacuated using a split flow multi-stage pump 106. The pump 106 comprises a pump envelope 108 in which a plurality of pumping stages 109, 110, 111 are supported for rotation about an axis 112 for pumping fluid from a main pump inlet 114 to a main pump outlet 116.

The envelope 108 forms a pump casing which structurally supports the pumping components of the pumping stages 109, 110, 111. The stator components may be fixed to and supported by the casing whilst the rotor components are fixed to and supported by a drive 112 which is itself supported by bearings (not shown) fixed to and supported by the casing.

The main pump inlet 114 is connected for evacuating a high vacuum stage 103. An inter-stage inlet 118 is provided between pumping stages and is connected for evacuating a lower vacuum stage 102. The low vacuum stage, may, for example, be evacuated by a backing pump 120.

In system 100, the split flow pump 106 is mounted with its axis X of rotation substantially parallel to the flow direction Y in the mass spectrometer. Such an arrangement can be utilised to increase conductance at the inter-stage inlet and reduce the height of the pump and instrument profile. However, in order to provide high pumping speed at the chamber 103, the inlet conductance between the chamber port 114 and the first pumping stage 109 must be relatively large. This is typically achieved by providing a relatively large space 122 in axial alignment with the pumping stage 109 and within the pumping envelope 108 (i.e. downstream of the main pump inlet 114 and upstream of the first pumping stage 109). In use, a pressure drop is generated between the main inlet 114 and the pumping stage 109 due to the flow of molecules and associated conductance of the port (sometimes referred to as pipe losses). Increasing the size of space 122 and decreasing a duct length minimises parasitic pressure drop between the main pump inlet 114 and the pumping stage 109 thereby maximising the pumping speed and minimising the pressure at the chamber.

The present invention provides a mass spectrometer system comprising: a mass spectrometer comprising a plurality of mass spectrometer stages in gas communication from a low vacuum stage to a higher vacuum stage; and a split flow multi-stage pump for evacuating the mass spectrometer stages, the pump comprising a pump envelope in which a plurality of pumping stages are supported for rotation about an axis generally parallel to the direction of flow in the mass spectrometer stages for pumping fluid from a main pump inlet to a main pump outlet, wherein at least part of a higher vacuum stage mass is located within the pump envelope at the main pump inlet.

The present invention also provides a mass spectrometer system comprising: a mass spectrometer comprising a plurality of mass spectrometer stages in flow communication from a low vacuum stage to a high vacuum stage; and a split flow multi-stage pump for evacuating the mass spectrometer stages, the pump comprising a pump envelope in which a plurality of pumping stages are supported for rotation about an axis generally parallel to the direction of flow in the mass spectrometer stages wherein at least part of one of the mass spectrometer stages is located in axial alignment with an upstream pumping stage.

Other preferred and/or optional aspects of the invention are defined in the accompanying claims.

In order that the present invention may be well understood, two embodiments thereof, which are given by way of example only, will now be described with reference to the accompanying drawings, in which.

Figure 1:
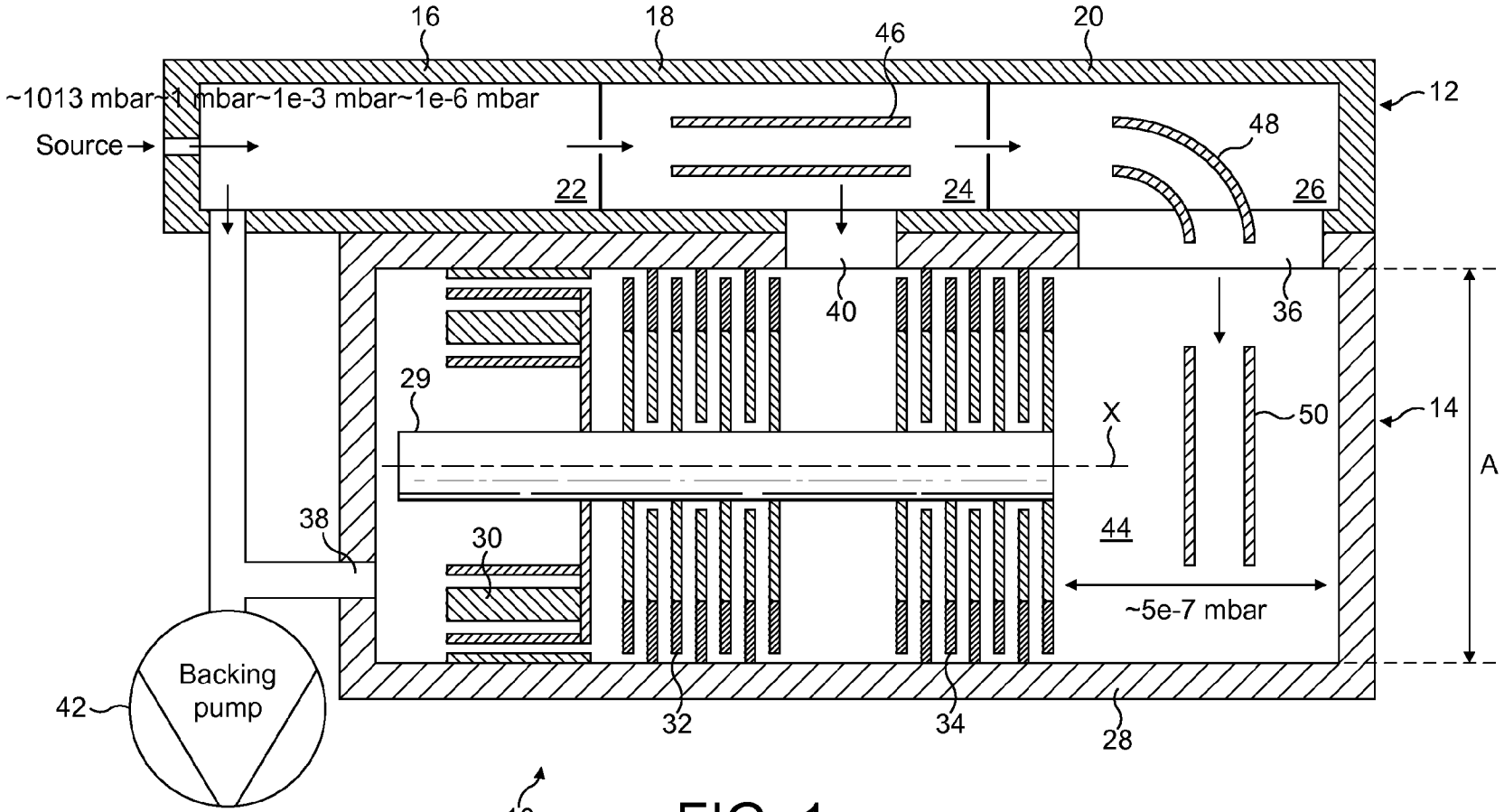
FIG. 1 shows a mass spectrometer system.

Referring to FIG. 1, a mass spectrometer system 10 is shown which comprises a mass spectrometer 12 and a split flow multi-stage pump 14. The mass spectrometer 12 comprising a plurality of mass spectrometer stages 16, 18, 20 in flow communication from a low vacuum stage 16 to a high vacuum stage 20. Flow from one stage to the next stage occurs generally in a direction to the right (as shown in the drawing) which is typically horizontal. The stages 16, 18, 20 comprise respective vacuum chambers 22, 24, 26.

The split flow multi-stage pump 14 comprises a pump envelope 28 in which a plurality of pumping stages 30, 32, 34 are supported for rotation about an axis X, generally parallel to the direction of flow in the mass-spectrometer, for pumping fluid from a main pump inlet 36 to a main pump outlet 38. An inter-stage inlet 40 is provided between pumping stages and is connected for evacuating a lower vacuum stages 16, 18. In this embodiment, an inter-stage inlet is provided between pumping stages 32 and 34. An inter-stage inlet may also or alternatively be provided between pumping stages 30 and 32. The low vacuum stage 22 is as shown evacuated by a backing pump 42 which also backs the main pump outlet 38.

The envelope 28 forms a pump casing which structurally supports the pumping components of the pumping stages 30, 32, 34. The stator components may be fixed to and supported by the casing whilst the rotor components are fixed to and supported by a drive 29 which is itself supported by bearings (not shown) fixed to and supported by the casing. The casing of the pump may be integral with the casing of the mass spectrometer.

The plurality of vacuum chambers 22, 24, 26 are differentially pumped by the vacuum pump 14 attached thereto and comprising two pump inlets 36, 40. The first pumping stage 34 exhausts to the second pumping stage 32 and the second pumping exhausts to the third pumping stage 30. The first pumping stage is connected through main pump inlet 36 to relatively high vacuum chamber 26 from which gas molecules can enter the pump through volume 44 from chamber 26 and pass through the first, second and third pumping stages towards the pump outlet 38. The second pumping stage is connected through inter-stage inlet 40 to a medium vacuum chamber 24 from which gas molecules can enter the pump through inter-stage inlet 40 and pass through the second and third pumping stages towards the pump outlet 38. The low vacuum chamber 22 may be evacuated by backing pump 42.

In this embodiment, pumping stage 30 comprises a molecular drag mechanism and pumping stages 32 and 34 comprise turbo molecular pumping mechanisms.

In order to maintain conductance at the main pump inlet a relatively large space 44 is provided in axial alignment with the pumping stage 34 and within the pumping envelope 28 (i.e. downstream of the main pump inlet 36 and upstream of the first pumping stage 34). Pumping stage 34 is the first or most upstream pumping stage. As indicated above with reference to the prior art, the space 44 allows the pumping stage 34 to work efficiently. The pressure in space 44 is lower than the pressure in chamber 26 immediately upstream of the main pump inlet because of the afore-mentioned conductance effects (pipe losses). In the prior art, there is a relatively large amount of redundant space in the pump which is simply required for porting the gas from the mass spectrometer into the vacuum pump. With the exception of providing reasonable conductance, this volume 122 serves no mechanical purpose and is therefore wasteful in terms of material costs, machining, instrument size and weight. Unlike the prior art, the present invention incorporates volume 44 into the mass spectrometer forming a high vacuum chamber in the pump envelope which in use is at higher vacuum than a chamber directly upstream thereof. Accordingly, an additional mass spectrometer stage is provided in the arrangement at high vacuum without increased overall size of the system.

As described in more detail below, instrumentation 50 of the mass spectrometer is located at least partially and preferably fully within the volume 44 of the pump and in axial alignment with the first pumping stage 34. The term "axial alignment" as used herein is shown illustratively in FIGS. 1 and 2. In this regard, the outer radial extent of the first pumping stage is shown by broken lines and coincides with an inner surface of the pump envelope 28 housing the pumping mechanism of the first pumping stage. The mass spectrometer instrumentation 50, which may include analysers or optics, is axially aligned with the first pumping stage 34 in FIG. 1 as it is located within the radial extent of the first pumping stage as shown by the double headed arrow 'A'.

Figure 2:
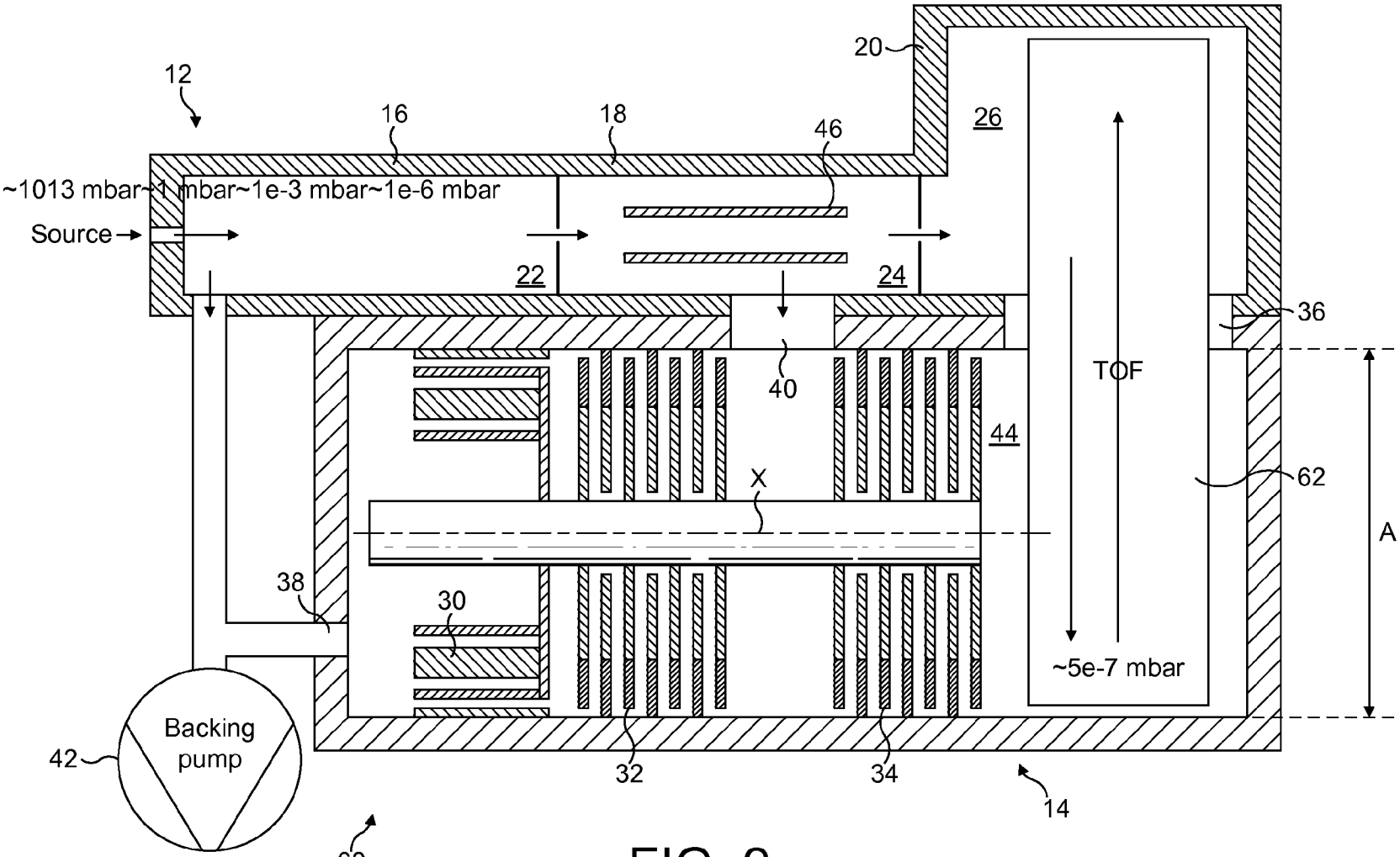
FIG. 2 shows another mass spectrometer system.
Figure 3:
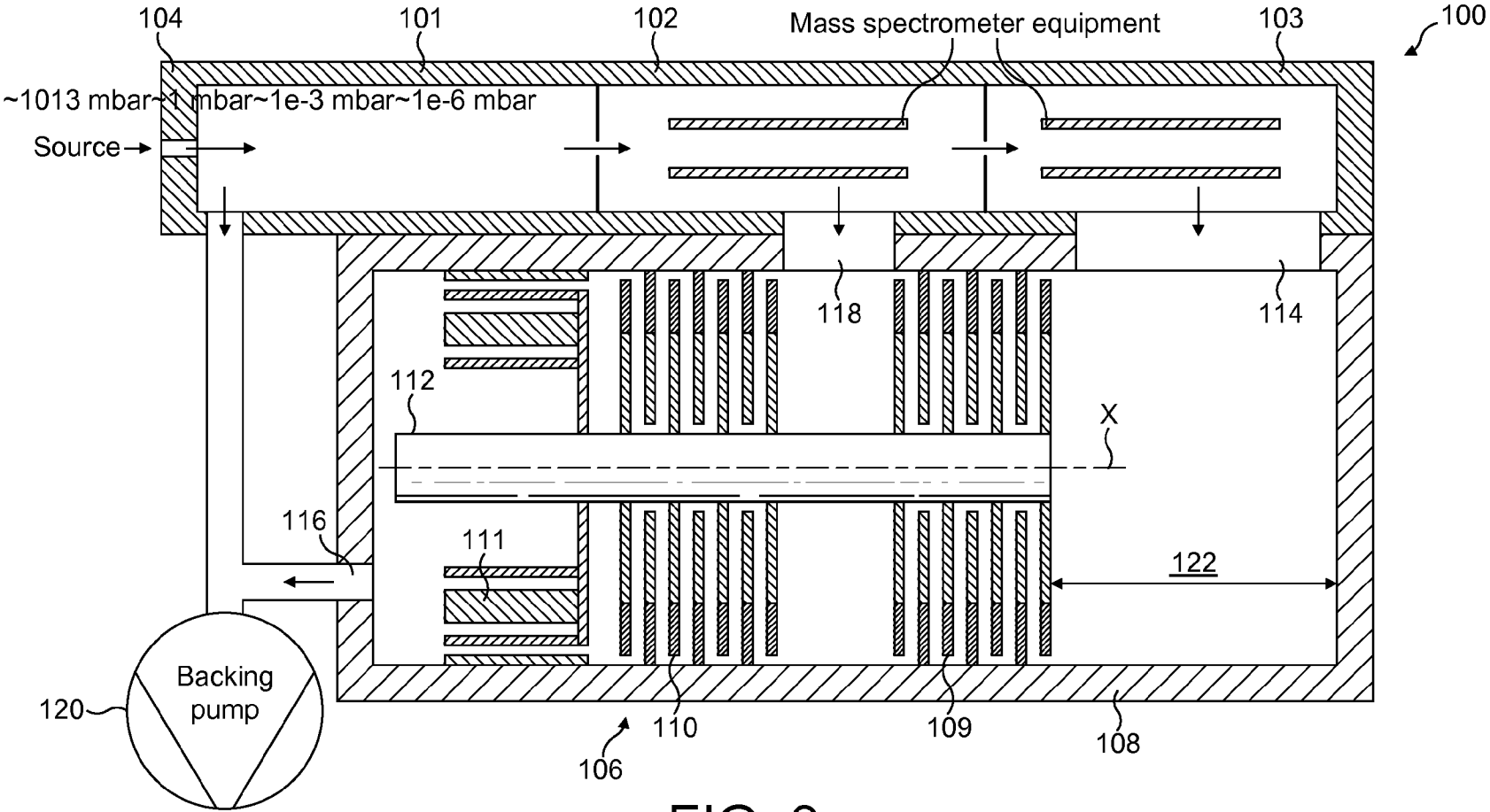
FIG. 3 shows a prior art mass spectrometer system.

As shown in FIGS. 1 and 2, the mass spectrometer instrumentation is axially aligned with the first the pumping stage. Further, the axis of rotation X of the pumping stages is horizontal. Accordingly, the sample gas flow direction, or ion path, through the mass spectrometer stages turns through approximately 90° or more so that the ion path is located partially within the pump envelope.

Mass spectrometer instruments 46, 48 are located in vacuum chambers 24, 26 and mass spectrometer instrument 50 is located in space 44 between the main pump inlet 36 and the first pumping stage 34.

The arrangement makes effective use of the space and provides a higher level of pumping performance for the equipment at the reduced pressure directly in front of the blades of the first pumping stage. It is noted in this regard, that the pressure in vacuum chamber 26 is about $10^{-6}$ mbar whereas the pressure in volume 44 is about $10^{-7}$ mbar. The amount of improvement in performance is dependant upon the conductance of the pump and porting, however, it is typically in the order of 50%.

Although, as shown in FIG. 1, instrument 50 is located wholly within the pumping envelope and in axial alignment with the first pumping stage 34, only part of the instrument 50 may be located within the pumping envelope and in axial alignment with the first pumping stage 34. Accordingly, at least part of one of the mass spectrometer stages is located within the pump envelope at the main pump inlet or in axial alignment with the pumping stage 34.

The instruments 46, 48, 50 are shown schematically, and may include various means for determining characteristics of a sample passing through the system. Sample ions are guided through the mass spectrometer (optics) towards equipment for analysing the ions (analyser). Both types of equipment (Optics and Analysers) may be incorporated in the embodiments described herein.

A mass spectrometer 60 is shown in FIG. 2 in which like reference numerals are used for like features shown in FIG. 1. Mass spectrometer 60 comprises a time-of-flight (TOF) instrument 62 which extends from space 44 within the pump envelope 28 through the main pump inlet 36 to vacuum chamber 26 directly upstream of inlet 36. Accordingly, mass spectrometer stage 20 bridges chamber 26 and space 44 and therefore the instrument 62 (and stage 20) is partially in axial alignment with the first pumping stage and within the envelope 28. The TOF stage makes specific use of the pipe losses which occur between mass spectrometer chamber 26 and volume 44. As indicated above, the pressure in chamber 26 is about $10^{-6}$ and the pressure in volume 44 is about $10^{-7}$. Accordingly, the arrangement provides a natural pressure gradient that the TOF instrument can utilise.

The invention claimed is:

1. A mass spectrometer system comprising:

a mass spectrometer comprising a plurality of differentially pumped mass spectrometer stages in gas communication from a low vacuum mass spectrometer stage to a high vacuum mass spectrometer stage; and a multi-stage vacuum pump configured to evacuate the differentially pumped mass spectrometer stages, wherein the multi-stage vacuum pump comprises a pump envelope in which a plurality of pumping stages, supported for rotation about an axis of rotation generally parallel to the direction of flow in the differentially pumped mass spectrometer stages, are configured for pumping fluid from a main pump inlet to a main pump outlet and wherein at least part of the high vacuum mass spectrometer stage is located within the pump envelope at the main pump inlet.

2. The mass spectrometer system of claim 1, further comprising an instrument for determining a characteristic of a mass spectrometer sample, wherein the instrument is at least partially located within the pump envelope at the main pump inlet.

3. The mass spectrometer system of claim 1, wherein part of an instrument or equipment from the mass spectrometer is located between the main pump inlet and a pumping mechanism of a first pumping stage of the plurality of pumping stages.

4. The mass spectrometer system of claim 1, wherein a spectrometer ion path is located partially within the pump envelope.

5. The mass spectrometer system of claim 2, wherein the instrument is located in axial alignment with the pumping stages of the multi-stage vacuum pump.

6. The mass spectrometer system of claim 1, wherein the axis of rotation is generally horizontal.

7. The mass spectrometer system of claim 1, wherein the high vacuum chamber, in use, is at higher vacuum than a chamber directly upstream thereof.

8. The mass spectrometer system of claim 1, further comprising a time-of-flight instrument, wherein the time-of-flight instrument extends between the pump envelope at the main pump inlet and a chamber directly upstream thereof.

9. The mass spectrometer system of claim 1, wherein at least one pumping stage of the plurality of pumping stages comprises a turbomolecular pumping mechanism.

10. The mass spectrometer system of claim 1, further comprising an interstage port located between a first pumping stage of the plurality of pumping stages and a second pumping of the plurality of pumping stages and connected to a mass spectrometer stage of the plurality of differentially pumped mass spectrometer stages.

11. A mass spectrometer system comprising:

a mass spectrometer comprising a plurality of mass spectrometer stages in flow communication from a low vacuum stage to a high vacuum stage; and a split flow multi-stage pump for evacuating the plurality of mass spectrometer stages, the split flow multi-stage pump comprising a pump envelope in which a plurality of pumping stages are supported for rotation about an axis of rotation extending generally parallel to the direction of flow in the mass spectrometer stages, wherein at least part of one of the mass spectrometer stages is located in axial alignment with an upstream pumping stage.

12. The mass spectrometer system of claim 11, further comprising an instrument for determining a characteristic of a mass spectrometer sample, wherein the instrument is at least partially located within the pump envelope at a main pump inlet of the split flow multi-stage pump envelope.

13. The mass spectrometer system of claim 11, wherein part of an instrument or equipment from the mass spectrometer is located between a main pump inlet and a pumping mechanism of a first pumping stage of the plurality of pumping stages.

14. The mass spectrometer system of claim 11, wherein a spectrometer ion path is located partially within the pump envelope.

15. The mass spectrometer system of claim 12, wherein the instrument is located in axial alignment with the pumping stages of the split flow multi-stage pump.

16. The mass spectrometer system of claim 11, wherein the axis of rotation is generally horizontal.

17. The mass spectrometer system of claim 11, wherein the high vacuum chamber, in use, is at higher vacuum than a chamber directly upstream thereof.

18. The mass spectrometer system of claim 11, further comprising a time-of-flight instrument, wherein the time-of-flight instrument extends between the pump envelope at a main pump inlet and a chamber directly upstream thereof.

19. The mass spectrometer system of claim 11, wherein at least one pumping stage of the plurality of pumping stages comprises a turbomolecular pumping mechanism.

20. The mass spectrometer system of claim 11, further comprising an interstage port located between a first pumping stage of the plurality of pumping stages and a second pumping of the plurality of pumping stages and connected to a mass spectrometer stage of the plurality of mass spectrometer stages.

* * * * *